US012781626B2

(12) United States Patent
Lin et al.

(10) Patent No.: US 12,781,626 B2
(45) Date of Patent: Nov. 3, 2026

(54) METHOD FOR TESTING CONDUCTIVITY OF UNSUPPORTED FRACTURES IN DEEP SHALE AFTER HYDRATION

(71) Applicant: Southwest Petroleum University, Chengdu (CN)

(72) Inventors: Ran Lin, Chengdu (CN); Lan Ren, Chengdu (CN); Jinzhou Zhao, Chengdu (CN); Zhihao Yu, Dongying (CN); Jianfa Wu, Chengdu (CN); Xuewen Shi, Chengdu (CN); Yi Song, Chengdu (CN); Cheng Shen, Chengdu (CN); Dengji Tang, Suining (CN)

(73) Assignee: Southwest Petroleum University, Chengdu (CN)

( * ) Notice: Subject to any disclaimer, the term of this patent is extended or adjusted under 35 U.S.C. 154(b) by 0 days.

(21) Appl. No.: 19/571,262

(22) Filed: Mar. 18, 2026

(65) Prior Publication Data

US 2026/0210243 A1 Jul. 23, 2026

(30) Foreign Application Priority Data

Jun. 13, 2025 (CN) ..... 202510791151.1

(51) Int. Cl.
*E21B 43/26* (2006.01)
*E21B 49/00* (2006.01)

(52) U.S. Cl.
CPC ..... *E21B 49/008* (2013.01); *E21B 43/26* (2013.01)

(58) Field of Classification Search
CPC ..... E21B 49/008; E21B 43/26
USPC ..... 166/250.1
See application file for complete search history.

(56) References Cited

U.S. PATENT DOCUMENTS

| | | | | |
|---|---|---|---|---|
| 6,749,022 | B1 * | 6/2004 | Fredd | C09K 8/72 166/250.1 |
| 8,151,884 | B2 * | 4/2012 | Kaminsky | E21B 43/30 166/302 |
| 2009/0065253 | A1 * | 3/2009 | Suarez-Rivera | E21B 43/17 166/250.1 |
| 2020/0300082 | A1 * | 9/2020 | Liu | G06F 30/28 |

* cited by examiner

*Primary Examiner* — William D Hutton, Jr.
*Assistant Examiner* — Ashish K Varma
(74) *Attorney, Agent, or Firm* — Birchwood IP

(57) ABSTRACT

The present application discloses a method for testing conductivity of unsupported fractures in deep shale after hydration. The method includes: selecting a rock sample from a target block, and dividing the rock sample into two portions; performing artificial fracturing on relative faces between the two portions to obtain fracture surfaces of the rock sample; soaking the two portions of the rock sample until a required hydration time is reached; assembling the two portions of the rock sample with a silicone gasket into a core chamber and injecting water into the rock sample; applying a horizontal closure stress to the rock sample, inducing shear slip of the rock sample under a set temperature and pressure, and measuring and collecting an injection flow rate; and calculating conductivity of the unsupported fractures after hydration based on the injection flow rate, and plotting a curve of rock sample conductivity versus flow rate.

7 Claims, 4 Drawing Sheets

METHOD FOR TESTING CONDUCTIVITY OF UNSUPPORTED FRACTURES IN DEEP SHALE AFTER HYDRATION

CROSS-REFERENCE TO RELATED APPLICATIONS

This application claims priority to Chinese Patent Application No. 202510791151.1, filed on Jun. 13, 2025, which is hereby incorporated by reference in its entirety.

TECHNICAL FIELD

The present application relates to a method for testing conductivity of unsupported fractures in deep shale after hydration, and belongs to the technical field of unconventional oil and gas exploration, development, and stimulation.

BACKGROUND

Deep shale gas development has become a hotspot of oil and gas exploration and development and an important replacement approach for production increase. During a shut-in process after hydraulic fracturing of deep shale gas, soaking of fracturing fluid leads to weakening of mechanical strength of natural fractures in deep shale, a critical activation pressure for shear failure of the natural fractures decreases, and further shear failure of the natural fractures occurs under action of high-pressure fluid in the fractures so as to form unsupported fractures. After failure of the natural fractures, a hydration effect further deteriorates mechanical strength of fracture surfaces of the unsupported fractures. The unsupported fractures constitute further extension of hydraulic fractures and are the key channel for communication between propped fractures and a deep shale matrix. Therefore, the conductivity of the unsupported fractures is highly important for hydraulic fracturing process design and production system optimization of deep shale gas. However, the protruding portions of fracture surfaces of the unsupported fractures that provide support are prone to collapse after hydration, and a contact mode between fracture surfaces gradually changes from point contact to surface contact, so that the fracture aperture decreases, and the conductivity is reduced. In view of the fact that an evolution law of fracture conductivity caused by a hydration effect during a shut-in period after hydraulic fracturing of deep shale gas remains unclear, a method for testing conductivity of unsupported fractures in deep shale after hydration is urgently required so as to quantitatively characterize fracture conductivity after fracturing of deep shale gas.

Previous researchers have conducted extensive research on variation characteristics of conductivity of hydraulic fractures in shale gas reservoirs. Fredd demonstrated that the fracture surface mismatch constitutes a necessary condition for conductivity of unsupported fractures. You Lijun et al. demonstrated that the stress sensitivity of unsupported fractures in shale is far greater than the stress sensitivity of propped fractures, and a hydration effect further enhances the stress sensitivity of the unsupported fractures. Wang et al. and Wu et al. demonstrated that, after hydration of unsupported fractures, the mechanical strength of fracture surfaces decreases, the roughness on surfaces of the unsupported fractures is worn when closure stress applied to the fractures increases during production, and the conductivity decreases significantly. Farah et al. pointed out that, after fracturing of deep shale, more than 50% of fracturing fluid may permanently remain in shale reservoirs due to existence of a large number of unsupported fractures, and the unsupported fractures constitute a main reason for a low flowback rate after fracturing of deep shale. Zhou et al. demonstrated that the deep shale has a high reservoir pressure and a large in-situ stress difference, the mechanical properties of shale also undergo significant changes due to a hydration effect under action of high closure overburden pressure, and the unsupported fractures rapidly fail after fracturing, resulting in rapid production decline after fracturing of deep shale.

At present, the experimental research on a dynamic evolution law of conductivity of unsupported fractures after hydration under actual reservoir conditions of deep shale remains limited. Therefore, it is necessary to conduct related research work, establish a method for testing conductivity of unsupported fractures in deep shale after hydration, reveal a variation law of conductivity of unsupported fractures in deep shale under fluid-solid interaction, and provide reference for establishment of a multiphase flow seepage model and a productivity evaluation method for shale gas, and for optimization of a fracturing flowback system and a production system.

SUMMARY

To overcome defects existing in the prior art, the present application aims to provide a method for testing conductivity of unsupported fractures in deep shale after hydration.

A technical solution provided by the present application for solving the above technical problem is a method for testing conductivity of unsupported fractures in deep shale after hydration, which includes the following steps:

S1. selecting a rock sample from a target block, and dividing the rock sample into two portions;

S2. performing artificial fracturing on relative faces between the two portions to obtain fracture surfaces of the rock sample;

S3. soaking the two portions of the rock sample until a required hydration time is reached;

S4. assembling the two portions of the rock sample with a silicone gasket into a core chamber and injecting water into the rock sample under a constant pressure;

S5. applying a horizontal closure stress to the rock sample, inducing shear slip of the rock sample under a set temperature and pressure, and measuring and collecting an injection flow rate; and S6. calculating conductivity of the unsupported fractures after hydration based on the injection flow rate, and plotting a curve of rock sample conductivity versus flow rate.

Further, in the step S1, a vertical slit perpendicular to end faces is cut at a middle position of two opposite end faces of the rock sample using a splitting knife, and the rock sample is thereby divided into two portions.

Further, in the step S2, two surfaces of the vertical slit are ground with a grinding wheel to achieve a roughness of 30 mesh.

Further, in the step S4, silicone gaskets are placed at upper and lower opposite ends of the two portions of the rock sample, and the assembly is subsequently inserted into a thermoplastic tube, and then loaded into the core chamber.

Further, in the step S4, silicone oil is injected into the core chamber for sealing and confining pressure application, and after the silicone oil fills the chamber, a temperature control unit is activated to raise a temperature of the rock sample to a preset value.

Further, in the step S5, a displacement-controlled method is used at a constant speed, and after an axial compression head just contacts a top end of the rock sample, the displacement control at a constant speed continues in an axial direction to compress the rock sample and induce shear slip, and the injection flow rate is collected.

Further, in the step S6, the calculation formula is as follows:

$$F = \frac{0.0017921/(1+0.03368T+0.000221T^2)QL}{h_f \Delta P}$$

where F is conductivity of the unsupported fractures of the rock sample, in D·cm; Q is an injection rate of an ISCO pump, in m3/s; ΔP is a pressure difference between an injection end and an outlet end of the fluid, in MPa; L is a flow distance of the fluid, in m; Tis a preset temperature, in ° C.; and hf is a fracture height, in m.

The present application has the following beneficial effects: the present application fully considers an effect of hydration on mechanical strength of unsupported fractures in deep shale during a shut-in period after fracturing of unsupported fractures, and provides a method for testing conductivity of unsupported fractures in deep shale after hydration. This method conducts physical experiments on mechanical characteristics of unsupported fractures in shale under a true triaxial stress state and hydration effect, and the experiments are close to field conditions, and provide a basis and method for accurately establishing a mathematical model of a shale reservoir.

DESCRIPTION OF EMBODIMENTS

The technical solutions of the present application will be described clearly and completely in conjunction with the accompanying drawings. It is apparent that the described embodiments are part of the embodiments of the present application, rather than all embodiments. Based on the embodiments of the present application, all other embodiments obtained by those of ordinary skill in the art without creative effort fall within the protection scope of the present application.

A method for testing mechanical strength of natural fractures in deep shale after hydration according to the present application specifically includes the following steps:

S1. A rock sample is selected from a target block and divided into two portions.

The large rock collected from the target block is cut into a rectangular rock sample of 50×50×100 mm required for the experiment using a cutting machine. The surfaces of the rock sample are then polished, and after polishing, three pairs of mutually parallel faces are obtained. A non-parallelism error of the processed rock sample surfaces does not exceed 0.02 mm (meeting requirements of the ISRM testing guidelines). A vertical slit perpendicular to the end faces is cut at a middle position of two opposite end faces of the rock sample using a splitting knife.

S2. Relative faces between the two portions of the rock sample are subjected to artificial fracturing to obtain fracture surfaces of the rock sample.

The two surfaces of the vertical slit are ground with a grinding wheel to achieve a roughness of 30 mesh, so as to simulate a microscopic morphology of unsupported fractures.

S3. The two portions of the rock sample are soaked until a required hydration time is reached.

S4. The two portions of the rock sample are assembled with silicone gaskets and loaded into a core chamber, and water is injected into the rock sample under a constant pressure.

Figure 1:
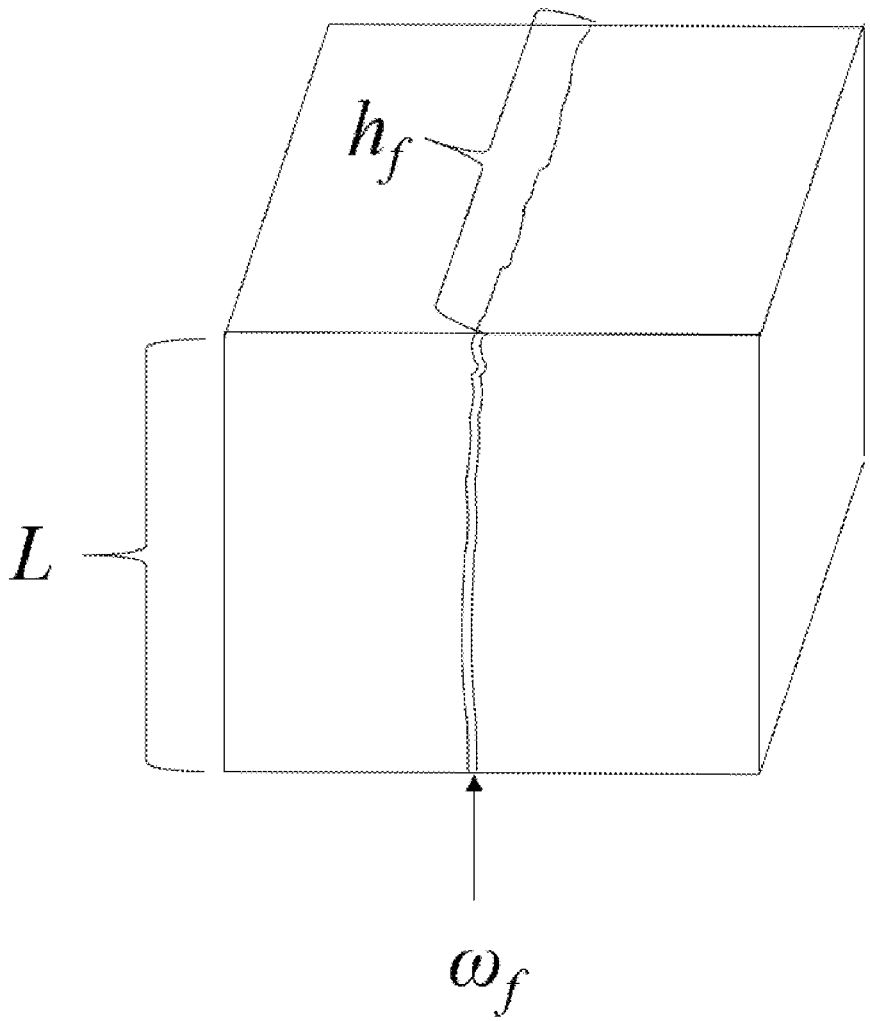
FIG. 1 is a schematic diagram of fluid flow in unsupported fractures of shale.
Figure 2:
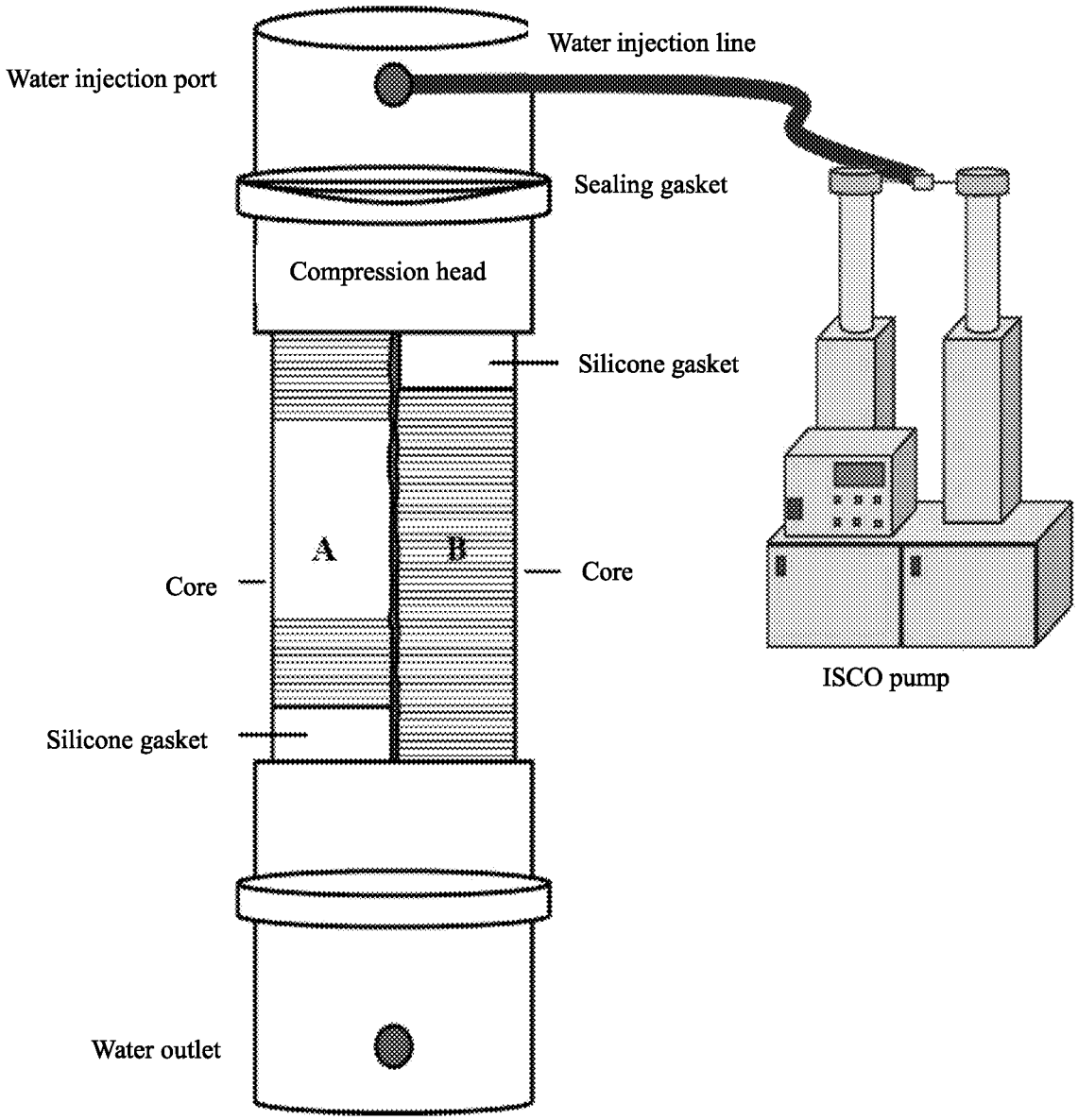
FIG. 2 is a schematic diagram of a mechanical strength testing device for unsupported fractures of shale.
Figure 3:
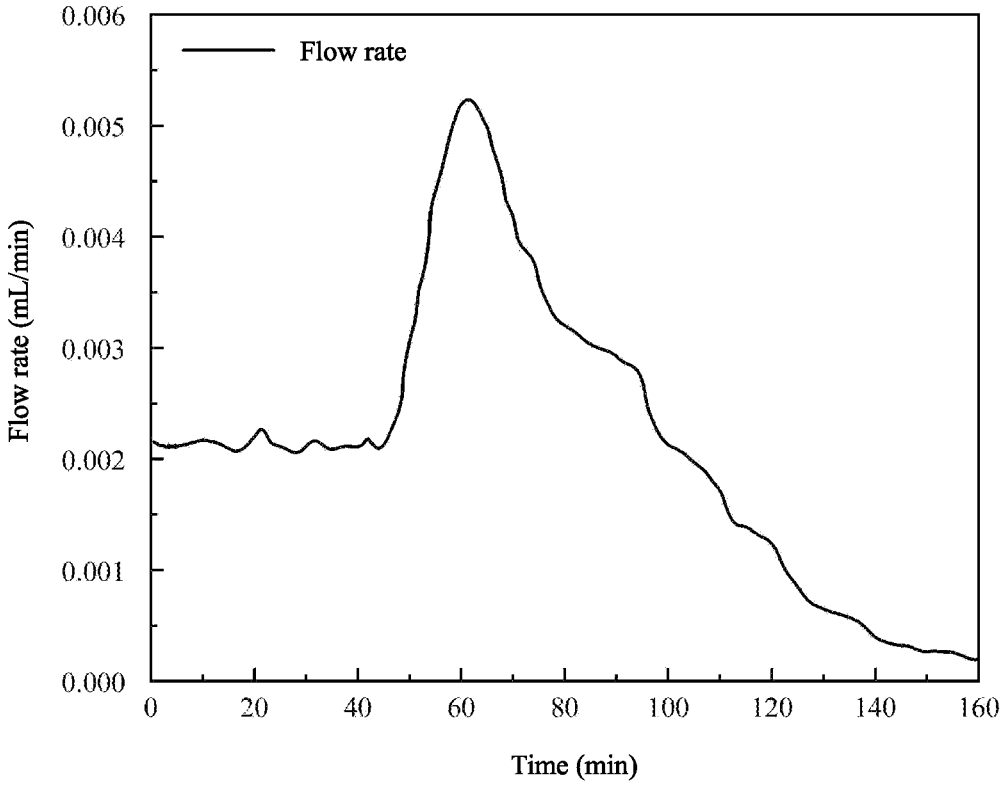
FIG. 3 is a variation curve of flow rate of a rock sample with time.
Figure 4:
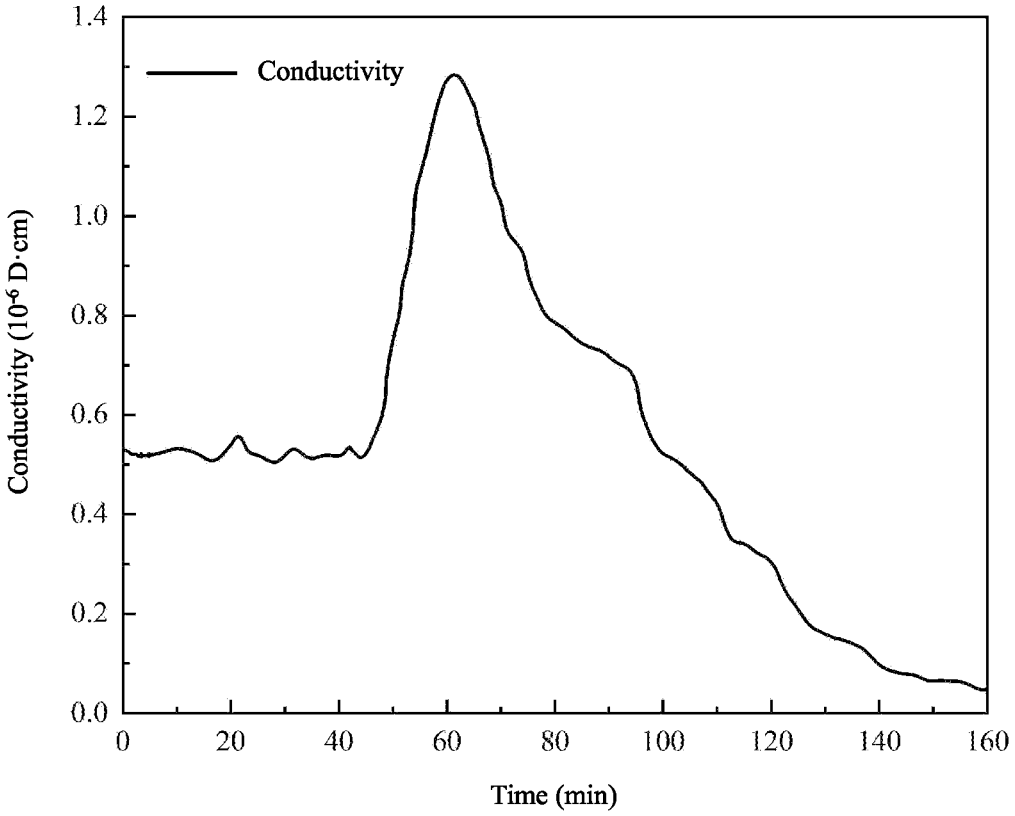
FIG. 4 is a variation curve of conductivity of a rock sample with flow rate.

Specifically, portions A and B of the rock sample are combined with silicone gaskets of 50×25×10 mm in size according to FIG. 2, subsequently inserted into a thermoplastic tube, and loaded into the core chamber. The silicone oil is then injected into the core chamber for sealing and confining pressure application. After the silicone oil fills the chamber, the temperature control unit of the GCTS is activated to raise the rock sample temperature to a preset value, with a temperature threshold reasonably set to avoid influence of temperature variation on experimental results. After temperature stabilization, the confining pressure is increased, and water is injected into the rock sample under a constant pressure using an ISCO pump.

S5. A horizontal closure stress is applied to the rock sample, and the rock sample is induced to undergo shear slip under a set temperature and pressure, and an injection flow rate is measured and collected.

Specifically, a horizontal closure stress of 85 MPa is applied to the rock sample to fix the rock sample, and a temperature of the testing system is raised to a preset value of 130° C. to simulate temperature conditions of a deep shale reservoir. A temperature threshold of 0.1° C. is set to avoid influence of temperature variations on experimental results. After temperature stabilization, the confining pressure is increased to 85.0 MPa.

Simultaneously, distilled water is continuously injected into the rock sample at a constant pressure of 82.0 MPa using an ISCO pump, so as to more realistically simulate a water-filled state of fracture surfaces during the shut-in period, fluid flow within the fracture, and an actual stress state of the fracture, thereby making the simulation closer to actual reservoir conditions in the field.

The rock sample is axially compressed using a displacement-controlled method at a constant speed of 0.018 mm/min to induce shear slip, and during this process, the flow rate Q is automatically collected by the ISCO pump.

S6. Conductivity of the unsupported fractures after hydration is calculated based on the injection flow rate, and a curve of rock sample conductivity versus flow rate is plotted.

A calculation formula for conductivity of the unsupported fractures after hydration of the rock sample is derived by substituting the measured values into the following expressions:

$$F = k\omega_f$$

$$Q = \frac{kA\Delta P}{\mu L}$$

-continued $$k = \frac{Q\mu L}{A\Delta P}$$

$$\mu = 0.0017921 / (1 + 0.03368T + 0.000221T^2)$$

$$F = \frac{0.0017921 / (1 + 0.03368T + 0.000221T^2)QL}{A\Delta P}\omega_f$$

where:

$$A = \omega_f h_f$$

further:

$$F = \frac{0.0017921 / (1 + 0.03368T + 0.000221T^2)QL}{h_f \Delta P}$$

where F is conductivity of the unsupported fractures of the rock sample, in D·cm; k is permeability of the unsupported fractures of the rock sample, in m2; of is fracture width, in m; Q is an injection rate of an ISCO pump, in m3/s; A is a unit cross-sectional area, 1 m2; ΔP is a pressure difference between an injection end and an outlet end of the fluid, in MPa; μ is viscosity of water, in Pa·s; L is flow distance of the fluid, in m; T is a preset temperature, in ° C.; and hf is a fracture height, in m.

When the injection flow rate of the pump is 0.002098 mL/min, the conductivity of the fracture of the rock sample is 5.1498×10–7 D·cm. The injection flow rates of the entire process are substituted into the calculation formula, and a curve of the conductivity of unsupported fractures in deep shale after hydration versus the injection flow rate of the pump is obtained. The comprehensive analysis of the above results shows that the measurement method has high feasibility and operability.

The above descriptions are not intended to limit the present application in any form. Although the above embodiments have disclosed the present application, these embodiments are not intended to limit the present application. Those skilled in the art can make changes and modify the technical content as equivalent changes of the equivalent embodiments using the technical content disclosed above without departing from the scope of the technical solutions of the present application. However, any simple modifications, equivalent changes and modifications made to the above embodiments according to the technical spirit of the present application without departing from the content of the technical solutions of the present application shall fall within the scope of the technical solutions of the present application.

What is claimed is:

1. A method for testing conductivity of unsupported fractures in deep shale after hydration, comprising the following steps:

(a) selecting a rock sample from a target block, and dividing the rock sample into two portions;

(b) performing artificial fracturing on relative faces between the two portions to obtain fracture surfaces of the rock sample;

(c) soaking the two portions of the rock sample in water until a required hydration time is reached;

(d) assembling the two portions of the rock sample with a silicone gasket into a core chamber and injecting water into the rock sample under a constant pressure;

(e) applying a horizontal closure stress to the rock sample, inducing shear slip of the rock sample under a set temperature and pressure, and measuring and collecting an injection flow rate of the injected water; and (f) calculating conductivity of the unsupported fractures after hydration based on the injection flow rate of the injected water, and plotting a curve of rock sample conductivity versus flow rate.

2. The method for testing conductivity of unsupported fractures in deep shale after hydration according to claim 1, wherein in the step (a), a vertical slit perpendicular to end faces is cut at a middle position of two opposite end faces of the rock sample using a splitting knife, and the rock sample is thereby divided into two portions.

3. The method for testing conductivity of unsupported fractures in deep shale after hydration according to claim 2, wherein in the step (b), two surfaces of the vertical slit are ground with a grinding wheel to achieve a roughness of 30 mesh.

4. The method for testing conductivity of unsupported fractures in deep shale after hydration according to claim 1, wherein in the step (d), silicone gaskets are placed at upper and lower opposite ends of the two portions of the rock sample, and the assembly is subsequently inserted into a thermoplastic tube, and then loaded into the core chamber.

5. The method for testing conductivity of unsupported fractures in deep shale after hydration according to claim 4, wherein in the step (d), silicone oil is injected into the core chamber for sealing and confining pressure application, and after the silicone oil fills the chamber, a temperature control unit is activated to raise a temperature of the rock sample to a preset value.

6. The method for testing conductivity of unsupported fractures in deep shale after hydration according to claim 1, wherein in the step (e), a displacement-controlled method is used at a constant speed, and after an axial compression head just contacts a top end of the rock sample, the displacement control at a constant speed continues in an axial direction to compress the rock sample and induce shear slip, and the injection flow rate is collected.

7. The method for testing conductivity of unsupported fractures in deep shale after hydration according to claim 1, wherein in the step (f), a calculation formula is as follows:

$$F = \frac{0.0017921 / (1 + 0.03368T + 0.000221T^2)QL}{h_f \Delta P}$$

wherein Fis conductivity of the unsupported fractures of the rock sample, in D·cm; Q is an injection rate of an ISCO pump, in m3/s; ΔP is a pressure difference between an injection end and an outlet end of the fluid, in MPa; L is a flow distance of the fluid, in m; Tis a preset temperature, in ° C.; and hf is a fracture height, in m.

* * * * *